United States Patent [19]

Thompson

[11] Patent Number: 4,651,578

[45] Date of Patent: Mar. 24, 1987

[54] WELL PUMPING UNIT

[75] Inventor: James E. Thompson, Dallas County, Tex.

[73] Assignee: United States Steel Corporation, Pittsburgh, Pa.

[21] Appl. No.: 864,240

[22] Filed: May 19, 1986

[51] Int. Cl.[4] ..... F16H 21/32

[52] U.S. Cl. ..... 74/41; 74/103; 292/51

[58] Field of Search ..... 74/41, 108, 103; 292/51, 202; 384/154, 156

[56] References Cited

U.S. PATENT DOCUMENTS

| | | | |
|---|---|---|---|
| 1,530,890 | 3/1925 | Hamaker | 74/103 |
| 1,564,320 | 12/1925 | Callahan | 74/41 |
| 1,699,675 | 1/1929 | Reschke | 74/41 |
| 1,751,767 | 3/1930 | Sperry | 74/41 |
| 1,789,216 | 1/1931 | Catron | 292/51 |
| 1,982,615 | 11/1934 | Mahan | 74/103 |
| 2,005,283 | 6/1935 | Winland | 74/103 |
| 2,046,275 | 6/1936 | Mahan | 74/103 |
| 2,057,917 | 10/1936 | Ratigan | 74/41 |
| 2,070,815 | 12/1936 | Cliarborn | 74/41 |
| 2,071,437 | 2/1937 | Searle | 74/41 |
| 2,079,276 | 5/1937 | Bloss | 74/41 |
| 2,094,547 | 9/1937 | McColloch et al. | 292/202 |
| 2,169,815 | 11/1938 | Patterson | 74/41 |
| 3,006,201 | 10/1961 | Ross | 74/41 |
| 4,092,872 | 6/1978 | McClure | 74/41 |
| 4,501,119 | 2/1985 | Stanton | 74/41 |

*Primary Examiner*—Peter A. Aschenbrenner
*Assistant Examiner*—Gerald A. Anderson
*Attorney, Agent, or Firm*—William F. Riesmeyer, III

[57] ABSTRACT

An improved oil well pumping unit has an arc latch which is remotely actuable so that a workman is not required to climb onto, or be in the immediate vicinity of the arc, in order to move the arc to an inoperative position spaced from the centerline of the well.

16 Claims, 15 Drawing Figures

WELL PUMPING UNIT

TECHNICAL FIELD

The present invention relates to well pumping units and, particularly, to an improvement for safely moving the arc of such units out-of-operation position with respect to the well.

BACKGROUND ART

In the production of oil from a well, a subsurface pump is commonly used. The pump is placed at a location below the level of oil in the well and has a plunger which is connected to a string of sucker rods extending upwardly through the well tubing. The sucker rod string and consequently the pump plunger is reciprocated by a well pumping unit and associated apparatus at the surface. The well pumping unit includes an oscillating walking beam having an arc attached at one end of the beam. A cable or rod supported on an outer curved surface of the arc is connected to the sucker rod string so that oscillation of the beam causes the pump plunger to reciprocate in an upward and downward direction forcing oil to the surface. To perform repairs on the well, it is necessary to move the arc in order to make the upper end of the well conveniently accessible. In the past, this has been done by removing the arc from the beam or by moving either the arc or beam away from the well. These operations have been very hazardous because of the need for personnel to work under or around the arc while it is in an unstable position. Two primary approaches have been taken in the design of pumping units for alleviating the hazardous nature of this operation. In one approach, the beam is moved laterally away from the well without detachment of the arc. Examples of this design are shown in U.S. Pat. Nos. 2,070,815, 2,169,815, 2,071,437 and 2,057,917. A disadvantage of these designs is that additional apparatus is required for moving the beam. Also, support for the beam is necessarily less rigid than when means is not provided for such movement. A second approach, shown in U.S. Pat. Nos. 3,006,201, 2,079,276 and 4,092,872, involves rotation of the arc upwardly about a pivot to a position in which it rests on top of the beam. This operation usually requires attaching cables to the arc so that it can be moved by a crane, necessarily requiring a workman to be in a hazardous position under the arc. In the event that the beam should unexpectedly move downward, the arc can swing like an ax posing a serious potential danger to workmen in the area. U.S. Pat. No. 4,092,872 shows a conventional arc latch which is not remotely actuable. This reference discloses removal of the arc in order to gain access to the well head. To remove the arc, a workman must remove a pin which holds the spring-biased arc latch in a position against the walking beam. To do this, he must climb onto the arc or stand on a ladder resting against the arc, placing him in a hazardous position.

It is a primary object of this invention to provide a well pumping unit in which the arc is safely movable out of operative position without requiring a workman to climb onto the arc or stand immediately adjacent to it.

DISCLOSURE OF INVENTION

A conventional well pumping unit includes a walking beam adapted to oscillate about a pivot axis and an arc pivotally connected to an upper portion of one end of the walking beam. In the improvement of this invention, the pivotal connection is located so that the arc is adapted for pivotal movement downwardly out of operative position with respect to the well when said one end of the walking beam is raised to an upper position by oscillation of the beam in a first direction about the pivot axis thereof. The improvement includes first latch means mounted on said one end of the walking beam pivotable about an axis parallel to the axis of said beam to alternate positions for (i) engaging a stop surface of said arc and maintaining said arc in operative position with respect to the well, and (ii) being disengaged from said stop surface for permitting the pivotal movement of said arc out of operative position with respect to the well. The invention also includes remotely actuable means for moving said latch means to the alternate positions thereof.

The invention enables placement of the arc safely in a position of least potential energy while service operations are performed. Furthermore, this can be accomplished without need for a workman to climb out on the end of the beam to unlatch or detach the arc from the beam. When the arc is unlatched it hangs in a naturally low position and does not need to be propped or tied in an unnatural, unsafe position.

MODES FOR CARRYING OUT THE INVENTION

Figure 1:
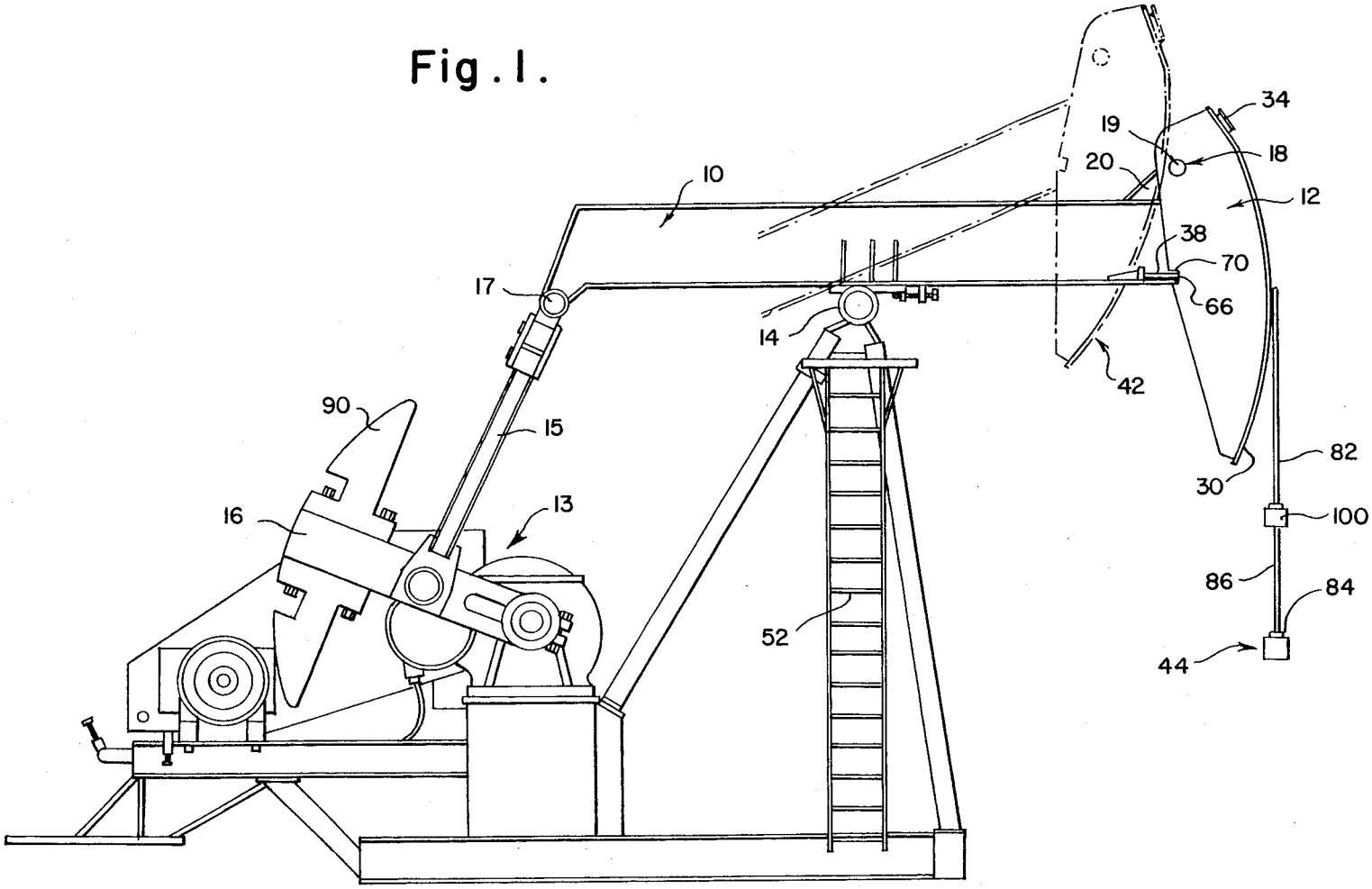
FIG. 1 is a side elevational view of the apparatus of the invention.
Figure 2:
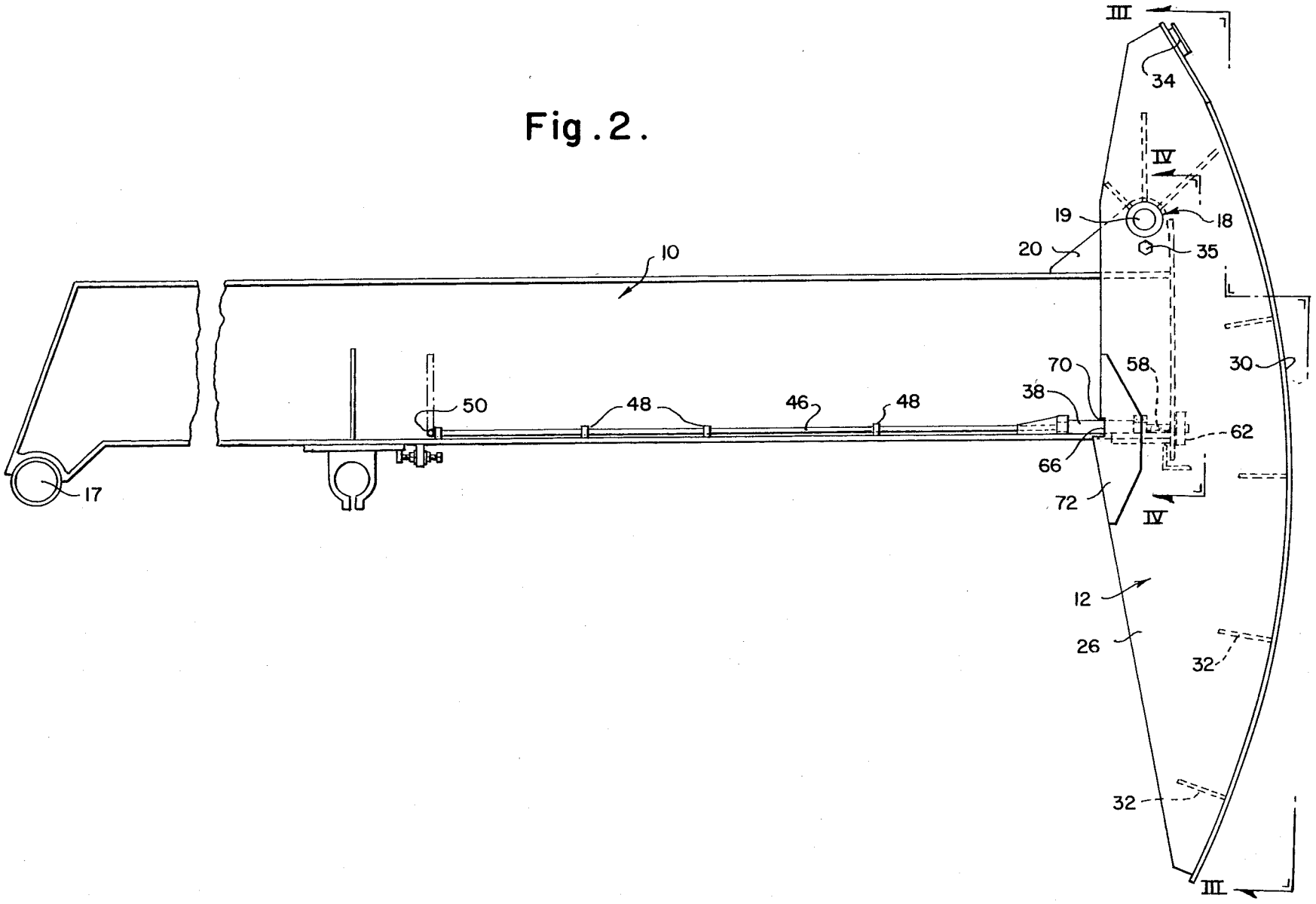
FIG. 2 is an enlarged side elevational view of a beam and arc similar to that illustrated in FIG. 1.
Figure 3:
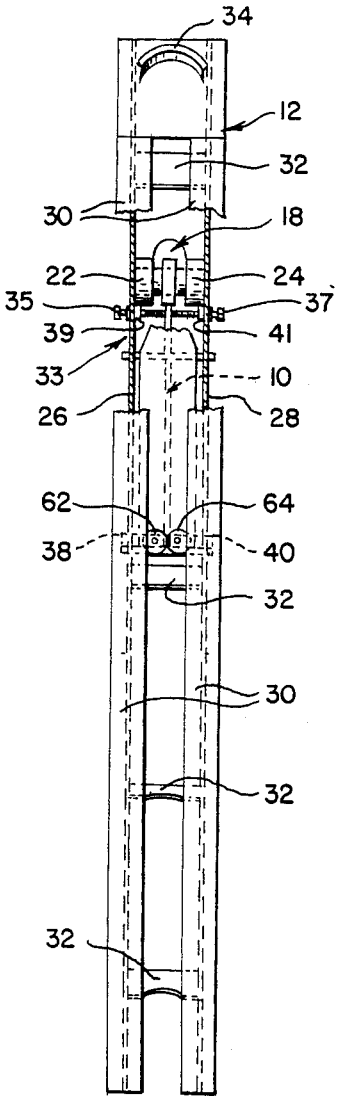
FIG. 3 is an end view of the arc taken from III—III on FIG. 2.
Figure 4:
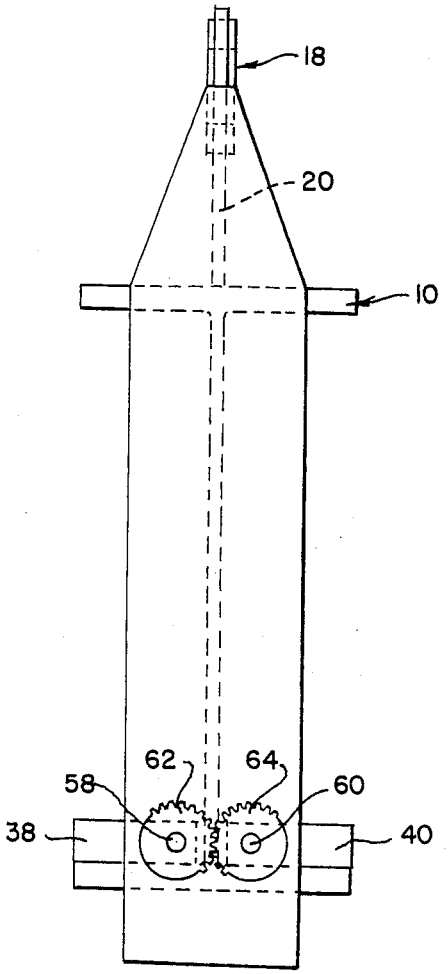
FIG. 4 is an end view of the beam taken from IV—IV on FIG. 2.
Figure 5:
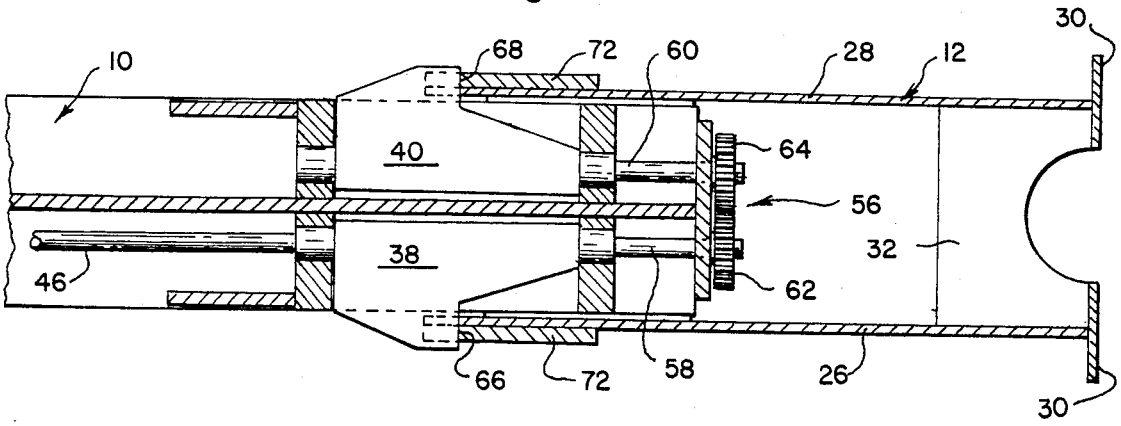
FIG. 5 is a plan view of a portion of the beam and the arc.
Figure 7:
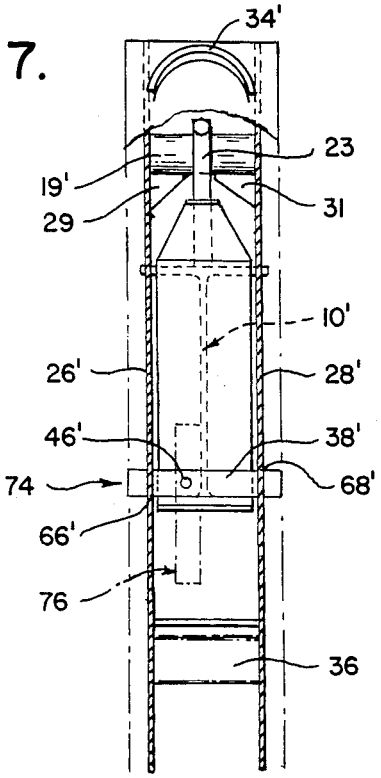
FIG. 7 is an end view of the arc taken from VII—VII of FIG. 6.
Figure 14:
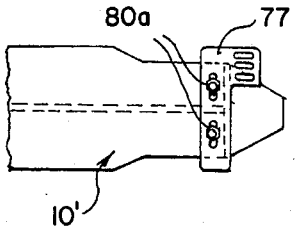
FIG. 14 is a plan view of one end of the walking beam illustrated in FIG. 6 showing the alignment plate attached to the beam.

Examples of conventional pumping units are shown in U.S. Pat. Nos. 2,079,276 and 1,972,660, the specifications of which are incorporated herein by reference. Such pumping units include a walking beam 10 and an arc 12 as shown in FIGS. 1 and 2. The walking beam has a housing 14 adapted to journal a pin mounted on a Samson post (the latter two parts not shown), the connection to the housing just mentioned serving as a fulcrum about which the beam may be oscillated. Conventional oscillation drive means 13 including a pitman 15 and counter-weighted crank arm drive unit 16 may be pivotally connected to the beam at pin journalling means 17. Arc 12 is pivotally attached at a connection 18 to an upper part of one end of the walking beam by pin 19 journalled in bracket 20 welded to the beam and spaced brackets 22 and 24 (FIG. 3) of the arc. Arc 12 includes spaced sideplates 26 and 28 connected by faceplates 30 and stiffener ribs 32. Arc 12 has a cableguide 34 on which a cable may be mounted for connecting the arc to a sucker rod string extending downwardly to a subsurface pump located in the well.

According to the improvement of the present invention remotely actuable first and second latches 38 and 40 are mounted on said one end of the walking beam at a spaced location beneath connection 18. The latches are pivotable to alternate positions for (i) permitting pivotal movement of the arc to an inoperative position 42 with respect to the well 44 upon oscillation of the beam about its pivot axis to a first or raised position, and (ii) maintaining said arc in the operative position with respect to the well upon oscillation of the beam back and forth about the pivot axis thereof. Means for remotely actuating the latches includes rod 46 attached to first latch 38. Rod 46 extends longitudinally through spaced brackets 48 along the lower flange of the beam and has a handle 50 which can be rotated by a workman standing on ladder 52 to alternate raised and lowered positions for pivoting first latch 38. Means 33 are provided for adjustably centering the arc on the beam. Means 33 includes a pair of jack screws 35 and 37 threadedly engaging nuts 39 and 41 mounted on sideplates 26 and 28, respectively. Means are provided for pivoting second latch 40 along with first latch 38 upon rotation of rod 46 by handle 50. Means 56 includes rods 58 and 60 attached to the first second latches, respectively, and engaged sector gears 62 and 64 mounted on the rods just mentioned. Latches 38 and 40 are each pivotable to a horizontal position in which they rest on the lower flange of the beam. In this position, the latches engage first and second stop surfaces 66 and 68, respectively, of the arc for maintaining the arc in operative position with respect to the well. By turning handle 50, the latches are raised to a vertical position disengaged from the first and second stop surfaces. The term, remotely, for purposes of the claims, is intended to mean that a workman is not required to climb onto or stand adjacent to the arc, i.e. the latches can be actuated from a ladder located near the center of the beam or from a position on the ground. The latches may be made actuable from ground level by mechanical means or electrical means. For example, a second rod extending downwardly toward the ground may be connected to rod 46 by gear means so that rotary movement of the second rod rotates the first and pivots the latch means to alternate positions. Preferably, the arc has notched surfaces one of which is shown at 70 for preventing accidental disengagement of the latches from their positions abutting the stop surfaces of the arc when the load of the sucker rod string is hanging on the arc. A check plate 72 is secured to each sideplate for reinforcement. Each check plate also has a continuation of notched surface 70 therein. These notched surfaces are adapted to permit automatic disengagement of the latches from the stop surfaces of the arc upon release of the load of the sucker rod string from the arc when the arc is in a second or generally horizontal position. Upon release of the sucker rod string load from the arc, the arc swings forward slightly so as to automatically disengage the latches from the stop surfaces of the arc.

Figure 6:
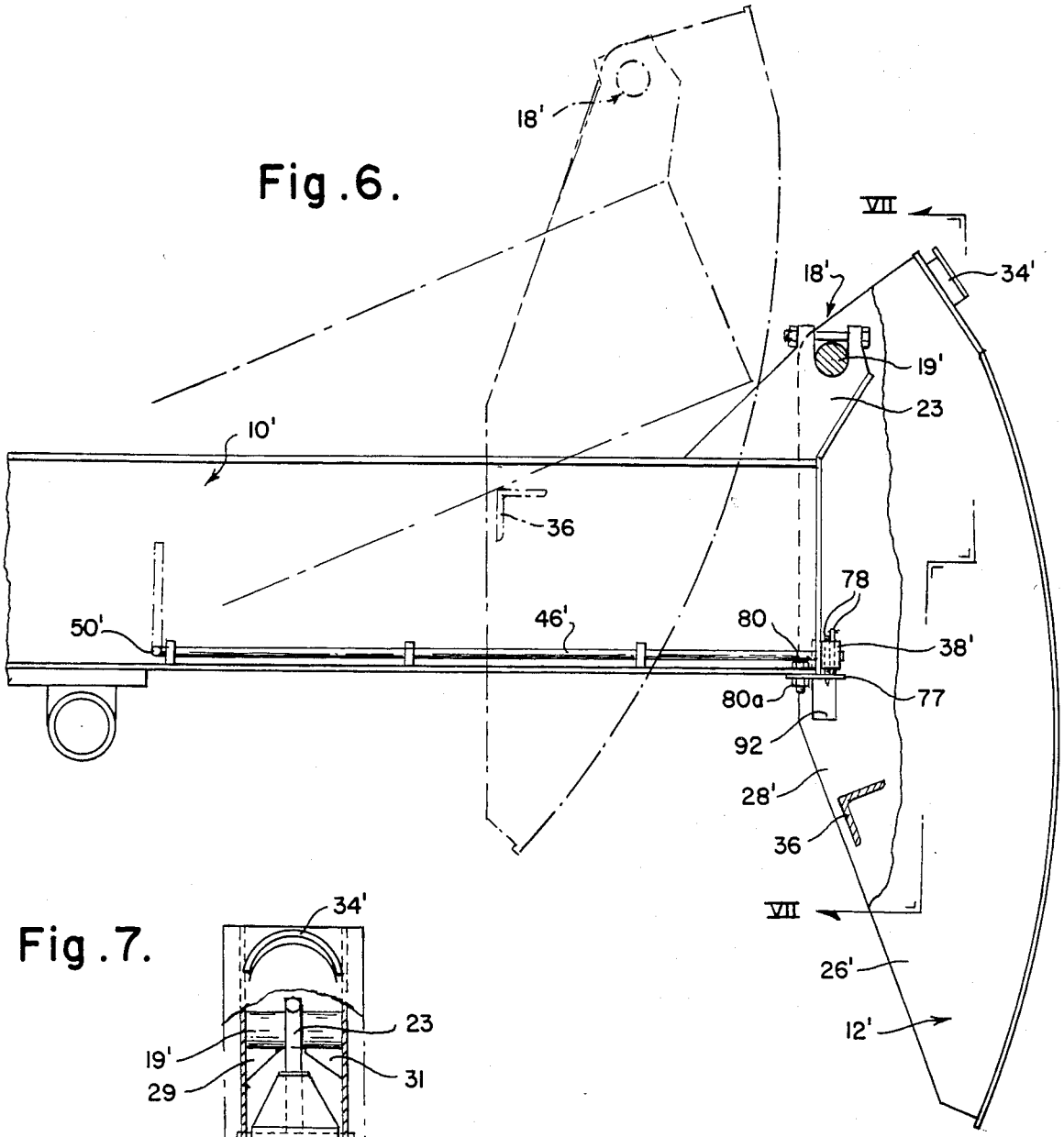
FIG. 6 is an enlarged side elevational view of the beam and arc in a more preferred embodiment of the invention.
Figure 6A:
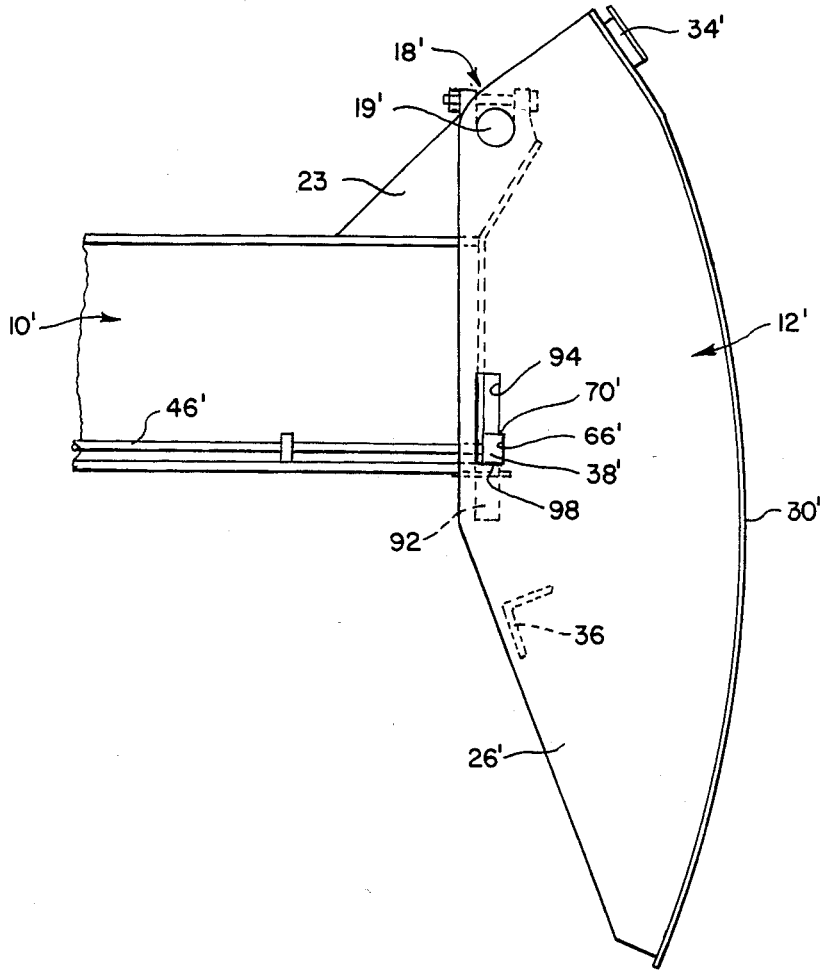
FIG. 6A is an enlarged side elevational view of the beam and arc showing the relationship of the windows in sideplates 26' and 28' of the arc.
Figure 8:
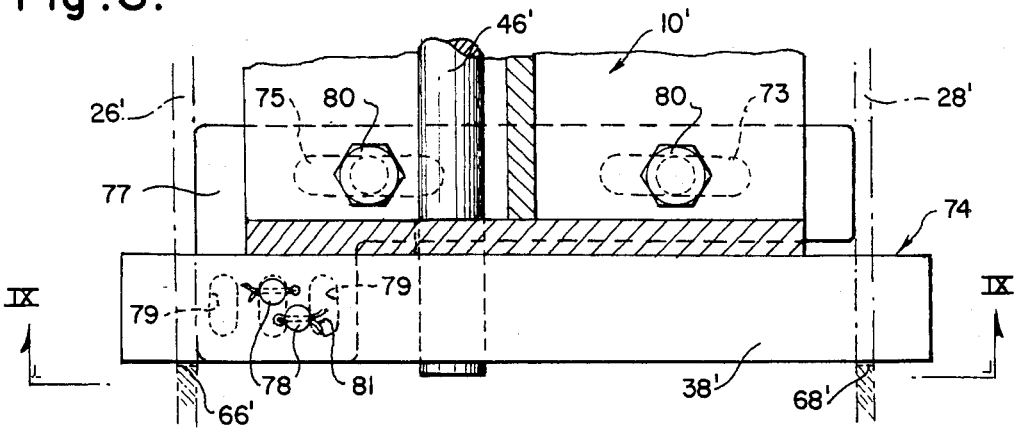
FIG. 8 is an enlarged plan view of the latch and alignment plates shown in FIG. 6.
Figure 9:
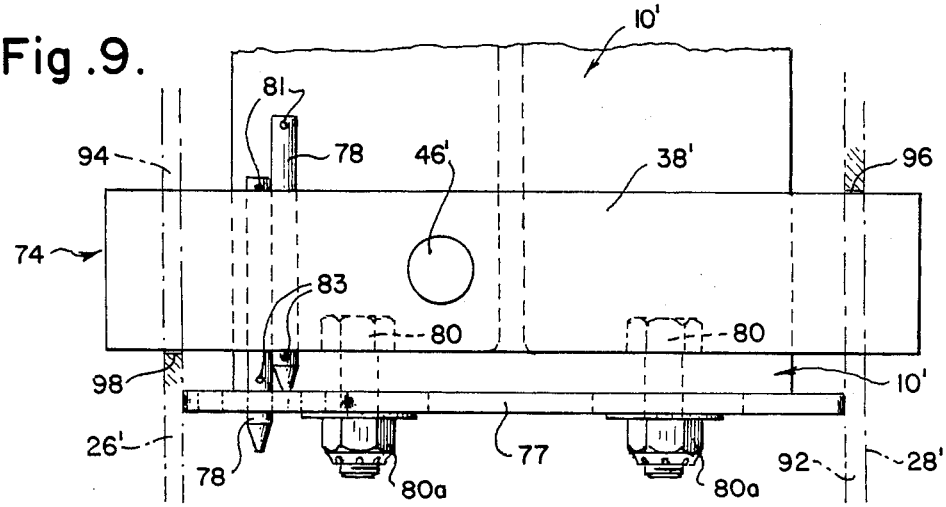
FIG. 9 is a side elevational view taken from IX—IX on FIG. 8.
Figure 10:
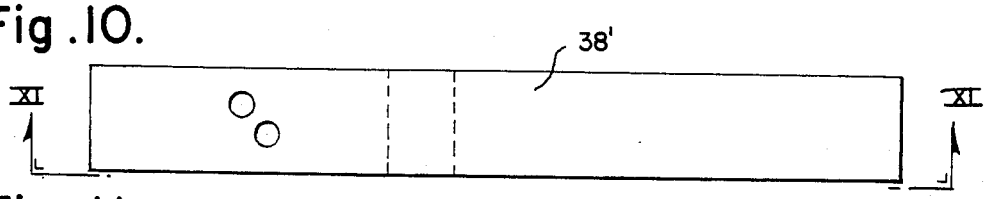
FIG. 10 is an enlarged plan view of the latch shown in FIG. 6.
Figure 11:
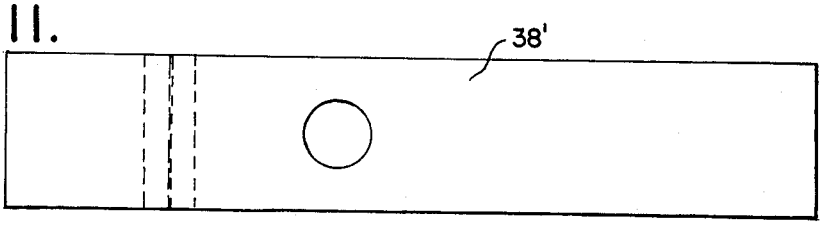
FIG. 11 is a side elevational view taken at XI—XI on FIG. 10.
Figure 12:
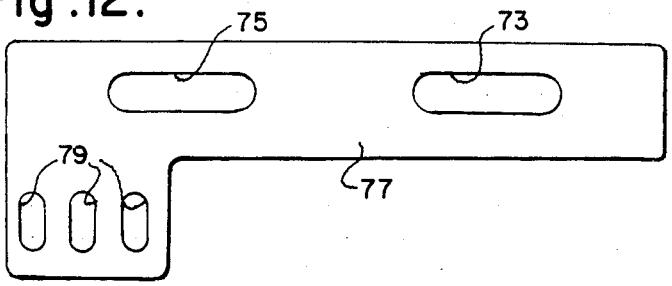
FIG. 12 is an enlarged plan view of the alignment plate shown in FIG. 6.
Figure 13:
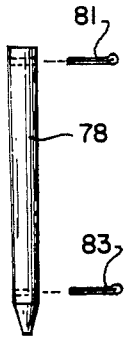
FIG. 13 is an enlarged side elevational view of the drop pin and cotter pins shown in FIG. 6.

A more preferred embodiment is illustrated in FIGS. 6 through 14 in which like parts are designated by the same numerals as in the prior embodiment having superscript primes therewith. In this more preferred embodiment, a single latch 38' (FIG. 6) is provided which is pivotable to alternate positions 74 and 76 (FIG. 7) by rotation of rod 46' which, in turn, is done manually by a person standing on ladder (not shown) turning handle 50'. A window opening 92 (FIGS. 6 and 6A) is provided in sideplate 28' of the arc and a similar window opening 94 (FIG. 6A) is provided in sideplate 26' to permit rotation of the latch. An upper surface 96 of window opening 92 and lower surface 98 of window opening 94 serve as abutment surfaces to limit the degree of rotation of the latch to the alternate positions desired. Latch 38' engages first and second stop surfaces 66' and 68' in position 74 for maintaining the arc in operative position with respect to the well. Notched surfaces 70' prevent accidental disengagement of the latch from position 74 as described above. In both this embodiment and the one previously described, the preferred locations for the center of gravity of the arc lie along a direction extending downwardly at an angle of substantially 70 degrees with respect to a horizontal plane through the axis of the pivotal connection of the arc to the upper portion of the beam. These locations for the arc center of gravity allow the arc to hang freely in the proper position for movement of latch 38' to position 74 when the beam is horizontal enabling easier movement of the latch without hindrance by the arc. In this embodiment, means is provided for automatically centering the arc with respect to the beam. The automatic centering means includes an alignment plate 77 (FIGS. 8, 9 and 12) which is loosely bolted (i.e. through oversize holes 73 and 75) by cap screws 80 and nuts **80*a* to the bottom of beam 10' so as to be laterally slidable to a degree sufficient for centering sideplates 26' and 28' of arc 12' with respect to the beam. Plate 77 has a plurality of spaced slots 79 for receiving pins 78 therein. Pins 78 are slidably mounted in latch 38' and have cotter pins 81 and 83 installed in spaced holes for limiting slidable movement of the pins. Proper vertical alignment, i.e. centering of the arc on the beam, is accomplished automatically when the arc hangs freely from the beam, i.e. when latch 38' is in unlatched position 76. Also, in this embodiment a more preferred connection 18' is provided for pin 19' of the arc to the beam. A saddle 23 is provided on the upper portion of the beam. The saddle has an upwardly facing open seat for receiving pin 19' downwardly therein. In this embodiment the need for a separate removable pin on the arc is eliminated, pin 19' may be welded to sideplates 26' and 28' of the arc. A third stop surface 33 is provided to prevent accidental disengagement of pin 19' from saddle 23, for example on rebound of the arc should the sucker rod string break while under load in the well. Plates 29 and 31 are provided in the preferred form, each having a third stop surface 33 for the purpose just mentioned. Finally, in this embodiment, a fourth stop surface 36 is provided to prevent excessive downward pivotal movement of the arc when the beam is moved to its upward position and the latch is disengaged from the first and second stop surfaces 66' and 68'** on the arc sideplates.

To move the arc safely out of operative position with respect to the well, a clamp 100 is placed on polish rod 83 at the well head 84 to support sucker rod string 86. The crank weights 90 are then rotated to the 12 o'clock position to put the arc at the bottom of its stroke. The polish rod yoke is disconnected and a workman climbs the ladder and unlatches the arc latch (or latches) as applicable by turning the rod handle to the raised position. The crank weights 90 are then allowed to rotate by gravity to the 6 o'clock position, raising the arc to the top of its stroke. The arc then hangs down from its pivotable connection several feet back from the centerline of the well in an "inoperative" position with respect to the well. To reconnect the arc to the well, the weights are raised to the 12 o'clock position and the polish rod yoke is reconnected. A workman on the ladder then turns the rod handle downward to pivot the latch (or latches) into position for engaging the stop surfaces on the sideplates of the arc. The crank weights are again rotated downward until the polish rod yoke picks up the sucker rod string. Then the clamp is removed from the polish rod and normal operation is resumed.

INDUSTRIAL APPLICABILITY

This invention is applicable to oil well pumping units and provides a safer way of moving the arc out of operative position with respect to the well, decreasing the potential for injury to workmen performing this task on pumping units previously used in the industry.

I claim:

1. In a well pumping unit, said pumping unit including a walking beam adapted for oscillation about a pivot axis and an arc pivotally connected to an upper portion of one end of said walking beam, the improvement in said pumping unit for enabling safe movement of the arc out of operative position with respect to the well which is characterized by:

said arc being adapted for pivotal movement downwardly out of operative position with respect to the well when said one end of the walking beam is raised to an upper position by oscillation of the beam in a first direction about the pivot axis thereof, first latch means mounted on said one end of the beam pivotable to alternate positions for (i) engaging a first stop surface of said arc and maintaining said arc in operative position with respect to the well, and (ii) being disengaged from said first stop surface for permitting the pivotal movement of said arc out of operative position with respect to the well, and remotely actuable means for moving said latch means to the alternate positions thereof.

2. The improvement of claim 1 which is characterized by said first latch means being pivotable about an axis parallel to the longitudinal axis of said beam to the alternate positions of said first latch means.

3. The improvement of claim 1 in which said arc is characterized by having a notched surface for preventing disengagement of the first latch means from the arc when the load of the sucker rod string is hanging on the arc.

4. The improvement of claim 1 which is characterized by said arc having a center of gravity lying in a direction extending downwardly at an angle of substantially 70 degrees with respect to a horizontal plane through the axis of the pivotal connection of said arc to the upper portion of said one end of the walking beam.

5. The improvement of claim 1 which is characterized by said walking beam having a saddle with an upwardly facing open seat at the upper portion of said one end of the beam, said arc having pin means adapted for easy insertion downwardly into the saddle and easy withdrawal upwardly therefrom.

6. The improvement of claim 1 which is characterized by said arc having a pair of sideplates spaced sufficiently to permit pivoting of said arc downwardly over the end of said beam to the inoperative position.

7. The improvement of claim 2 which is characterized by rod means connected to said first latch and extending longitudinally along said beam to a location remote from said one end thereof, said rod means being axially rotatable for moving the first latch to the alternate positions thereof.

8. The improvement of claim 3 which is characterized in that the notched surface is adapted to become disengaged from the first latch means upon release of the load of the sucker rod string from the arc, said arc swinging sufficiently outwardly from said beam upon release of said load to disengage the first latch means from said notched surface.

9. The improvement of claim 5 which is characterized by said arc having a third stop surface for preventing accidental disengagement of said pin means from the saddle.

10. The improvement of claim 6 which is characterized by said pair of sideplates each having a window opening, said first latch means extending longitudinally through said window openings and being pivotable about an axis parallel to the longitudinal axis of the beam to said alternate positions, one of said window openings having a lower surface serving as an abutment surface to limit pivotal movement of the first latch means in one direction, the other of said window openings having an upper surface serving as an abutment surface to limit pivotal movement of the first latch means in the opposite direction of pivotal movement thereof.

11. The improvement of claim 6 further characterized by a second latch means, said first and second latch means engaging first and second stop surfaces, respectively, located on the pair of sideplates of the arc.

12. The improvement of claim 6 which is further characterized by means for maintaining said sideplates of the arc in centered alignment with respect to said beam.

13. The improvement of claim 9 which is characterized by said arc having a fourth stop surface for preventing excessive downward pivotal movement of the arc.

14. The improvement of claim 11 further characterized by means connecting the second latch to the first latch for pivoting the second latch concurrently with the first latch to the alternate positions thereof.

15. The improvement of claim 12 which is characterized by said centering means including means for adjusting the position of the sideplates of said arc with respect to said beam.

16. The improvement of claim 15 which is characterized by an alignment plate mounted on said one end of the beam adjacent a lower portion of said one end thereof, said plate being adapted for limited slidable movement horizontally between the sideplates of the arc for automatic centering of the arc with respect to the beam upon installation of the arc on the beam, said alignment plate having a plurality of spaced slots extending vertically downwardly therethrough, said arc having a pair of pins slidably mounted thereon and located so that one of said pins will drop into one of the slots in said plate, upon automatic centering of the arc with respect to the beam.

* * * * *